United States Patent [19]

Onoue et al.

[11] 4,308,717

[45] Jan. 5, 1982

[54] DUST REMOVING MECHANISM IN OPEN-END SPINNING FRAME

[75] Inventors: Keiji Onoue, Kariya; Takashi Katoh, Toyoda; Yoshiaki Yoshida, Obu; Kazuo Seiki, Kariya, all of Japan

[73] Assignee: Kabushiki Kaisha Toyoda Jidoshokki Seisakusho, Aichi, Japan

[21] Appl. No.: 121,015

[22] Filed: Feb. 13, 1980

[30] Foreign Application Priority Data

Feb. 19, 1979 [JP] Japan ..... 54/20976[U]

[51] Int. Cl.[3] ..... D01H 7/885; D01H 11/00

[52] U.S. Cl. ..... 57/301; 57/58.91

[58] Field of Search ..... 57/58.89–58.95, 57/301, 302, 304

[56] References Cited

U.S. PATENT DOCUMENTS

| | | | |
|---|---|---|---|
| 3,624,997 | 12/1971 | Didek et al. | 57/58.91 |
| 3,792,575 | 2/1974 | Doudlebsky et al. | 57/301 |
| 3,800,520 | 4/1974 | Schiltknecht | 57/58.91 |
| 3,826,071 | 7/1974 | Grau | 57/301 |
| 3,839,855 | 10/1974 | Stalder | 57/58.91 |

*Primary Examiner*—John Petrakes

*Attorney, Agent, or Firm*—Burgess, Ryan and Wayne

[57] ABSTRACT

In the open-end spinning unit provided with a casing and a combing roller rotatably mounted in the casing, a spinning rotor producing a twisted yarn from individual fibers carried from a combing zone defined by the combing roller, a carrying space formed between the combing roller and the inside surface of the casing, a mechanism for feeding a bundle of fibers into an upstream terminal of the carrying space, a dust removing mechanism communicated with the carrying space for discharging dust particles separated from useful fibers carried to the spinning rotor, and a combing roller provided with a plurality of combing elements, helically mounted on a main cylindrical surface thereof, the inside top or bottom surface of the dust removing formed in the dust removing mechanism is projected inside to a level corresponding to a level defined by an imaginary plan of a rotational trace of either one of the terminal ends of the combing elements helically mounted on a cylindrical body of the combing roller, in the condition relative to the possible flying direction influenced by the component force of the centrifugal force created by the high speed motion of said combing elements of the combing roller.

3 Claims, 6 Drawing Figures

DUST REMOVING MECHANISM IN OPEN-END SPINNING FRAME

SUMMARY OF THE INVENTION

The present invention relates to a dust removing mechanism in the conventional open-end spinning frame and more particularly, an improvement of the dust removing mechanism applied for the conventional open-end spinning frame.

In the conventional open-end spinning frame, it is known that a dust removing mechanism is applied to each unit of an open-end spinning machine. Such dust removing mechanism is disclosed in U.S. Patent Application Ser. No. 971,499, filed Dec. 20, 1978, now U.S. Pat. No. 4,204,393. According to the disclosure of that U.S. Patent application, in each spinning unit, provided with a combing roller and a spinning rotor for creating a yarn from fibers supplied from the combing roller, a casing partly surrounds the combing roller and a dust removing aperture is formed in the casing. A dust removing zone is formed in a space between the combing roller and the inside surface of the casing so that it communicates with the dust removing aperture.

The dust removing aperture is communicated with a dust discharging aperture and an auxiliary air stream inlet apperture. The dust particles introduced into the dust removing aperture are discharged outside of the spinning unit by way of the dust discharging aperture while the separation of dust particles from the useful fibers can be effectively carried out in the dust removing zone by the aid of the auxiliary air stream through the inlet aperture.

However, according to the experience of the present inventors in actual mill operation of open-end spinning frames utilizing the above-mentioned dust removing mechanism, it was found that, since the relative position and size of the dust removing aperture to the space between the combing roller and the inside wall of the casing is constructed so as to effectively communicate the dust removing aperture with the above-mentioned space, without consideration having been given to the influence of the rotational direction of the combing roller or the disposition of the saw teeth or pins on the cylindrical surface of the main body of the combing roller, the return of dust particles into the space between the combing roller and the inside surface of the casing can not be completely prevented. Moreover, it was found that an additional air stream into the above-mentioned space via the dust removing aperture is created. Consequently, the air stream from the side of a feed roller to the combing roller is weakened so that unexpected deposition of dust particles on a position about the feed roller can not be prevented.

To solve the above-mentioned problem, in the conventional open-end spinning frame, the desirable volume of air stream from the side of the feed roller is maintained by increasing the rotational speed of the spinning rotor of each spinning unit. However, such increase of the rotational speed of the spinning rotor results in a large increase in power consumption.

The primary purpose of the present invention is to provide an improved dust removing mechanism by which the above-mentioned drawbacks involved in the conventional open-end spinning frame can be eliminated, so as to improve the dust removing efficiency thereof, that is, to improve the quality of yarn produced by the open-end spinning machine.

The other purpose of the present invention is to effectively remove dust particles deposited around the feed roller and to reduce the power consumption of the spinnig rotor.

To attain the purposes of the present invention, the opening of the dust-removing aperture formed in the casing of each open-end spinning unit is designed as follows. That is, in the open-end spinning unit provided with a casing and a combing roller rotatably mounted in the casing, a spinning rotor producing a twisted yarn from individual fibers carried from a combing zone defined by the combing roller, a carrying space formed between the combing roller and the inside surface of the casing, a mechanism for feeding a bundle of fibers into an upstream terminal of the carrying space, a dust removing mechanism communicated with the carrying space for discharging dust particles separated from useful fibers carried to the spinning rotor, and the combing roller provided with a plurality of combing elements helically mounted on a main cylindrical surface thereof, the inside top or bottom surface of the dust removing aperture formed in the dust-removing mechanism is projected inside to a level corresponding to a level defined by an imaginary plane of a rotational trace of either one of the terminal ends of the combing elements helically mounted on a cylindrical body of the combing roller, in the relation to the possible flying direction influenced by the component force of the centrifugal force created by the high speed motion of the saw teeth of the combing roller 5. Due to the projection of the top or bottom surface of the dust removing aperture toward inside of the aperture, the siae of the opening of the dust removing aperture which faces the combing roller is reasonably reduced compared with that of the conventional dust removing aperture and, therefore, the problem due to the additional suction air stream through this dust removing aperture can be effectively solved.

DETAILED EXPLANATION OF THE INVENTION

For the sake of a better understanding the present invention, the problems involved in the known dust removing mechanism utilized for the conventional open-end spinning frame will first be explained in more detail.

Figure 1:
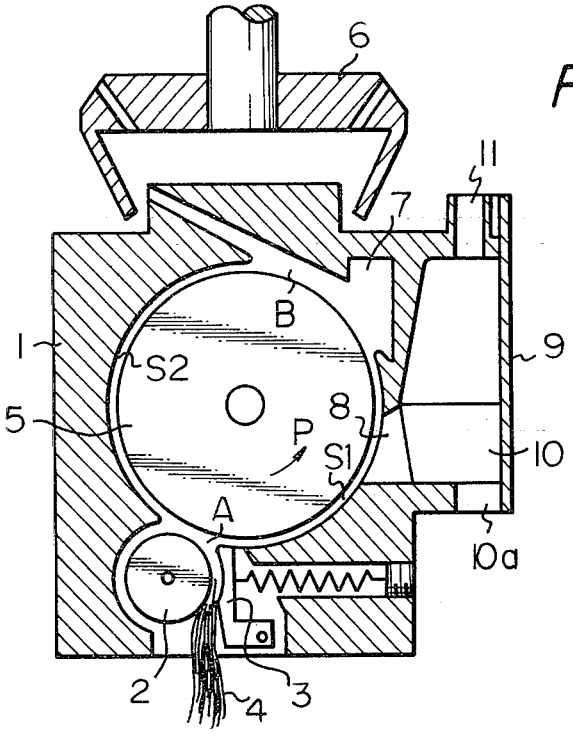
FIG. 1 is a schematic sectional plan view of the open-end spinning unit of the conventional open-end spinning frame.
Figure 2:
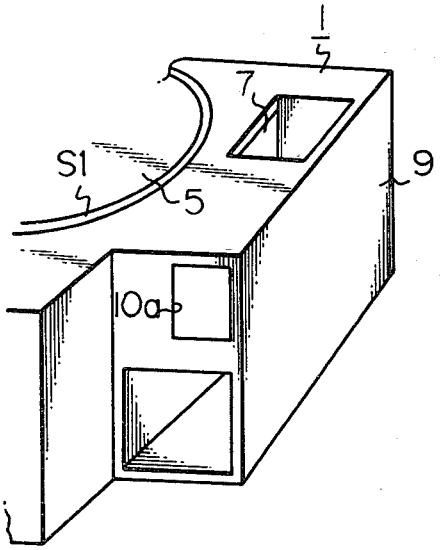
FIG. 2 is a perspective view of a conventional dust removing mchanism applied to the open-end spinning frame illustrated in FIG. 1.

In the known open-end spinning unit illustrated in FIG. 1, a sliver 4 is fed into a combing zone A by the action of a feed roller 2 cooperated with a presser 3. The fed silver 4 receives a combing action of a combing roller 5 and separated individual fibers created by the combing action are carried to a doffing zone B by way of a space $S_1$ formed between the combing roller 5 and the inside wall of a combing housing 1. Then, the individual fibers carried to the doffing zone B are introudced into a spinning rotor 6 by an air stream from an air supply chamber 7, which is created by sucking action of the spinning rotor 6. After that a twisted yarn is made from the individual fibers supplied to the spinning rotor 6.

Figure 3:
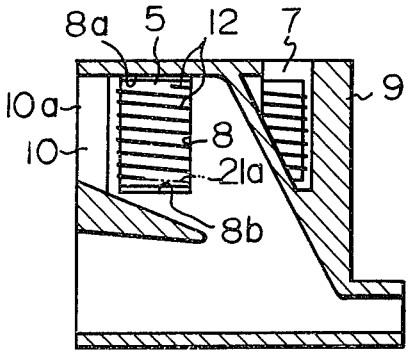
FIG. 3 is a sectional side view of the dust removing mechanism applied to the open-end spinning unit illustrated in FIG. 1.
Figure 4:
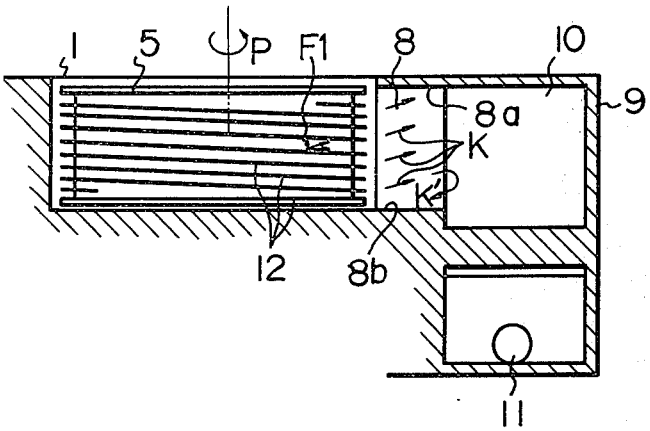
FIG. 4 is a front sectional view of the dust removing mechanism illustrated in FIG. 3.

During the above-mentioned operation, to remove very small fibers, trash and other impurities, which are hereinafter referred to as dust or dust particles, a dust-removing aperture 8, having a transversal cross section of substantially square shape is formed in the casing 1. Referring to FIGS. 3 and 4, the aperture 8 is so formed that an upper inside surface 8*a* of the aperture 8 is located at a position slightly above an upper end of the combing roller 5, while a lower side surface 8*b* of the aperture 8 is located at a position slightly below a lower end of the combing roller 5. The dust removing aperture 8 communicates with a dust collecting chamber 10 of a dust collecting device 9.

In the above-described dust-removing mechanism, the dust particles are discharged from the carrying space between the combing roller 5 and the inside wall of the casing 1 by the centrifugal force of the combing roller 5 via the dust removing aperture 8 into the dust collecting chamber 10. Then, the dust particles are discharged outside the spinning unit by way of a discharging conduit 11 disposed at the bottom of the dust collecting chamber 10.

In the above-described mechanism of the open-end spinning unit shown illustrated in FIG. 1., the combing roller 5 is provided with a combing wire 12 helically mounted on the cylindrical surface of the main body thereof in a left hand screw condition as illustrated in FIGS. 3 and 4 and the combing roller 5 is rotated in the counter clockwise direction in FIG. 4. Consequently, the dust particles, which are forced to fly by the centrifugal force caused by the rotation of the combing roller 5, receive a component force $F_1$ directed upward. As a result, each dust particle has a tendency to fly toward the direction represented by arrows K in FIG. 4 when it flies through the dust removing aperture 8, and the dust particles, particularly the dust particles which fly from the bottom portion of the combing roller 5, tend to return into the space between the combing roller 5 and the inside wall of the casing 1 due to the suction air stream introduced into the spinning rotor 6 from an open portion 10*a* formed in the dust collecting chamber 10, which suction air stream is created by the sucking action of the spinning rotor 6, as indicated by an arrow K′ in FIG. 4. Such return of the dust particles into the above-mentioned space reduces the effective dust removing capacity of the dust removing mechanism.

From research conducted by the present inventors, it was found that a part of the above-mentioned dust particles, returned into the space between the combing roller 5 and the inside wall of the casing 1 from the dust removing aperture 8, is carried toward the feed roller 2 via a space $S_2$ (FIG. 1) between the combing roller 5 and the inside wall of the casing 1 which is downstream of the doffing zone B. Those dust particles tend to deposit on a position surrounding the feed roller 2, and, then, tend to be sucked by a suction air from the side of the feed roller 2, which is created by the suction force of the spinning rotor 6.

As already pointed out hereinbefore, in the above-mentioned dust removing mechanism, the additional suction air stream into the above-mentioned space from the dust removing aperture 8 is also created by the suction force of the spinning rotor 6. It is recognized that such additional suction air weakens the suction air stream from the side of the feed roller 2. Therefore, if the size of the sectional area of the dust removing aperture 8 is larger, the influence of the additional suction air upon the suction air stream from the side of the feed roller 2 becomes more distinguish. In the above-mentioned dust removing mechanism illustrated in FIGS. 1, 2, 3 and 4, the rotational speed of the spinning rotor 6 is increased so as to overcome the influence of the additional air stream through the aperture 8. However, as already pointed out, such solution to eliminate the influence of the additional suction air stream through the aperture 8 results in an increase of power consumption.

Based on the above-mentioned analysis of the function of the dust removing mechanism utilized for the open-end spinning frame, the following basic ideas to improve this mechanism were formulated by the present inventors.

In the above-mentioned dust removing mechanism:

(1) the position of the top side surface and the bottom side surface of the dust-removing opening must be formed in the relation of the mounting condition of the combing element such as the combing wire on the combing roller;

(2) it is not necessary to cover the entire width of the combing roller along its rotational axis by the transversal cross-sectional area of the dust removing aperture, if the flying of the dust particles through the dust removing aperture can be effectively created.

Based upon the above-mentioned basic ideas regarding the dust removing mechanism, the following described improvement of the dust removing mechanism was created, which improvement is hereinafter explained in detail with reference to the embodiments illustrated in FIGS. 5 and 6.

Figure 5:
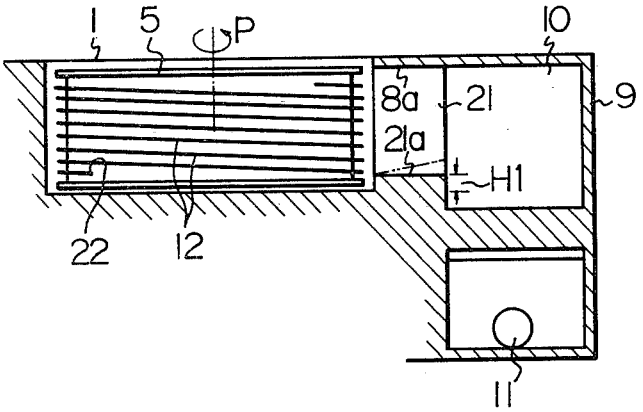
FIG. 5 is a front sectinal view of one embodiment of the dust removing mechanism, according to the present invention.

In the dust removing mechanism according to the present invention illustrated in FIG. 5, which is applied to an open-end spinning unit provided with the combing roller 5, wherein the combing wire 12 is mounted in a left hand screw groove (not shown) formed on a cylindrical surface of the main body of the combing roller 5, and the combing roller 5 is rotated in the counter clockwise direction in FIG. 5, the construction of the dust removing mechanism is similar to that of the conventional one illustrated in FIGS. 1, 2, 3 and 4, except that the following improvement is applied. That is, in a dust removing aperture 21, corresponding to the dust removing aperture 8 shown in FIG. 1, 3 and 4, a bottom inside surface 21*a* of the aperture 21 is projected upward by a height $H_1$ from the bottom side of the combing roller 5 to a level which corresponds to an imaginary plane defined by a rotation trace of a bottom terminal 22 of the combing wire 12. Consequently, the size of the opening of the dust removing aperture 21, which faces the combing roller 5, is decreased as compared with the conventional dust-removing mechanism illustrated in FIGS. 1, 2, 3 and 4. Therefore, since the excess space in the conventional mechanism is eliminated in the dust removing aperture 21, dust particles which fly from the combing roller 5 can be effectively prevented from returning into the space between the combing roller 5 and the inside wall of the casing 1 which is created by turning back of the dust particles toward the combing roller 5 along the bottom inside surface 21*a* of the dust removing aperture 21.

Since the size of the opening of the aperture 21 facing the combing roller 5 is reduced by the above-mentioned upward projection of the bottom inside surface of the aperture 21, the suction force of the suction air stream from the side of the feed roller 2 becomes stronger than with the conventional mechanism illustrated in FIGS. 1, 2, 3 and 4. Therefore, the deposition of dust particles on positions about the feed roller 2 can be effectively prevented.

Due to the above-mentioned creation of an effective suction air stream from the side of the feed roller 2, it is not required to rotate the spinning rotor 6 at a high speed to compensate for the insufficient strength of the suction air stream from the side of the feed roller 2. In other words, the necessity for the excess consumption of the driving power to rotate the spinning rotor 6 at the above-mentioned high speed is eliminated.

Figure 6:
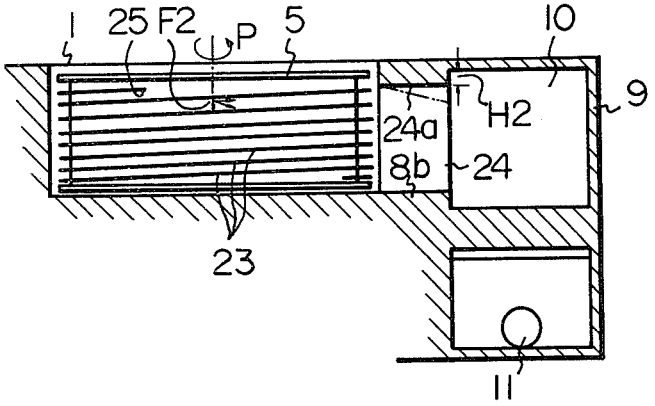
FIG. 6 is a front sectional view of another embodiment of the dust removing mechanism according to the present invention.

In the dust removing mechanism according to the present invention illustrated in FIG. 6, which is applied to an open-end spinning unit provided with the combing roller 5, wherein the combing wire 12 is mounted in a right hand screw groove (not shown) formed on a cylindrical surface of the main body of the combing roller 5 and the combing roller 5 is rotated in the counterclockwise direction in FIG. 6, a very similar construction to that of the embodiment illustrated in FIG. 5 is applied. That is, the only difference in the construction of the mechanism illustrated in FIG. 6 is how the dust removing aperture 24, which correspond to the aperture 21 of the embodiment illustrated in FIG. 5, is designed.

As will be understood from the previous explanation of the drawbacks of the conventional dust removing mechanism, when the dust particles are introduced into the dust removing aperture, they receive the centrifugal force creaed by the combing roller 5 and an axial component of the carrying force of the combing wire 12. In this embodiment, the above-mentioned axial component is a force $F_2$ directed downward along the rotational axis of the combing roller 5. Therefore, the problems observed in the conventional dust removing mechanism, of the possible turning back of the dust particles from the dust removing aperture into the space between the combing roller 5 and the inside surface of the casing 1 and the compensation of the insufficient strength of the suction air stream from the side of the feed roller 2 by the excessive high speed rotation of the spinning rotor 6, can be solved by expanding an upper surface 24*a* of the dust removing aperture 24 by a height $H_2$ to a level which corresponds to a level of an imaginary plane defined by a rotation trace of a top terminal 25 of the combing wire 23. Accordingly, the size of the opening of the dust removing aperture 24, which faces the combing roller 5, is decreased in compared with the conventional dust removing aperture illustrated in FIGS. 1, 2, 3 and 4.

In the above-mentioned explanation of the dust removing mechanism, the open-end spinning unit is provided with a combing roller whereon a combing wire is helically mounted on a cylindrical surface of the main body thereof. However, the present invention is not limited to such an open-end spinning unit. In other words, the present invention can be successfully applied to the open-end spinning unit provided with a combing roller wherein a plurality of combing pins are helically mounted on the cylindrical surface of the main body thereof. Therefore, the term "combing elements helically mounted on the main body of the combing roller", used in the claims, is interpreted as the combing elements such as saw teeth of the metallic wire 12 or a pluraity of pins (not shown) helically mounted on the main body of the combing roller 5.

The following modification of the dust removing mechanism of the present invention illustrated in FIGS. 5 and 6, the cross-sectional size of the dust removing aperture is gradually reduced from the inside position to the outside position as represented by a two-dot-dash line in those drawing.

As explained hereinbefore in detail, in the present invention, the top surface or the bottom surface of the dust removing aperture is projected to a level which corresponds to a level of an imaginary plane defined by a rotation trace of either one of the terminal ends of the combing wire helically mounted on the main body thereof, in the relation to the flying direction of the dust particles in the dust removing aperture. Since the dust particles once separated from the useful fibers being carried to the spinning rotor 6 do not return into the space defined by the combing roller 5 and the inside surface of the casing 1, the trash content of the yarn produced by the open-end spinning frame can be remarkably decreased, so that the better quality yarn compared with the conventional yarn can be produced. Since the opening size of the dust removing aperture is reduced in the present invention, the above-mentioned problems due to the additional air stream introduced from the dust removing aperture into the space between the combing roller 5 and the inside surface of the casing 1 can be effectively solved.

What is claimed is:

1. In an open-end spinning unit provided with a casing and a combing roller rotatably mounted in said casing, a spinning rotor producing a twisted yarn from individual fibers carried from a combing zone defined by said combing roller, a carrying space of fibers formed between a rotational surface of said combing roller and an inside surface of said casing partly surrounding said combing roller, a dust removing mechanism communicated to said carrying space for discharging dust particles separated from useful fibers being carried to said spinning rotor, said combing rotor provided with a plurality of combing elements helically mounted on a cylindrical surface of a main body of said combing roller in a left hand screw or a right hand screw condition, an improved dust removing mechanism comprising a dust removing aperture communicated with said fiber carrying space, said dust removing aperture provided with top and bottom inside surfaces, either one of said top and bottom inside surfaces positioned at a side corresponding to the direction of progress of an imaginary right hand screw or an imaginary left hand screw when those screws are turned counter clockwise being projected inward to a level corresponding to a plane defined by a rotational trace of either one of terminal ends of said helical arrangement of said combing element which is positioned at said progressing side, while the other one of said top and bottom inside surfaces being formed at a level corresponding to a plane defined by a side of said combing roller.

2. An improved dust removing mechanism according to claim 1, wherein said combing elements are helically mounted on said main body of said combing roller in the right hand helical arrangement and said combing roller is rotated in a counter clockwise direction, said bottom inside surface is projected inward to a level corresponding to an imaginary plane defined by a rotational trace of a bottom terminal of said helical arrangement of said combing elements.

3. An improved dust removing mechanism according to claim 1, wherein said combing elements are helically mounted on said main body of said combing roller in the left hand helical arrangement and said combing roller is rotated in a counter clockwise direction, said top surface is projected inward to a level corresponding to an imaginary plane by a rotational trace of a top terminal of said helical arrangement of said combing elements.

* * * * *

UNITED STATES PATENT AND TRADEMARK OFFICE

CERTIFICATE OF CORRECTION

PATENT NO. : 4,308,717

DATED : January 5, 1982

INVENTOR(S) : Keiji Onoue, et al

It is certified that error appears in the above—identified patent and that said Letters Patent is hereby corrected as shown below:

In the Abstract, line 14: "removing forming" should be --removing aperture forming--.

Column 1, line 49: "can not" should be --cannot--.

Column 2, line 6: "spinnig" should be --spinning--.

Column 3, line 18: "cross section" should be --cross-section--.

Column 4, line 15: "distinguish" should be --distinguished--.

Column 5, line 41: "creaed" should be --created--.
line 56: "rotation" should be --rotational--.
line 59: "in" should be --as--.

Column 6, line 8: "pluraity": should be --plurality--.
line 10: "The" should be --In the--.
line 20: "rotation" should be --rotational--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*